United States Patent [19]

Kato

[11] 4,438,713

[45] Mar. 27, 1984

[54] EMBROIDERY STITCH FORMATION DEVICE FOR SEWING MACHINE

[75] Inventor: Takashi Kato, Kiryu, Japan

[73] Assignees: Eltac Co. Ltd., Sizuoka; Tokai Industrial Sewing Machine Co. Ltd., Kasugai, both of Japan; part interest to each

[21] Appl. No.: 494,555

[22] Filed: May 13, 1983

[30] Foreign Application Priority Data

| | | | |
|---|---|---|---|
| May 18, 1982 | [JP] | Japan | 57-83713 |
| May 18, 1982 | [JP] | Japan | 57-83714 |
| May 18, 1982 | [JP] | Japan | 57-72212[U] |
| Jun. 22, 1982 | [JP] | Japan | 57-107055 |

[51] Int. Cl.[3] ..... D05C 3/02; D05C 7/08

[52] U.S. Cl. ..... 112/100

[58] Field of Search ..... 112/100, 99, 101, 98

[56] References Cited

U.S. PATENT DOCUMENTS

| | | | |
|---|---|---|---|
| 1,041,584 | 10/1912 | Borton | 112/100 |
| 1,066,490 | 7/1913 | Groebli | 112/100 |
| 1,327,646 | 1/1920 | Weis | 112/100 |
| 1,707,068 | 3/1929 | Rubel | 112/100 |
| 1,762,479 | 6/1930 | Maier | 112/100 |
| 2,067,340 | 1/1937 | Prazak | 112/100 |
| 2,699,742 | 1/1955 | Smith | 112/100 |

*Primary Examiner*—H. Hampton Hunter

*Attorney, Agent, or Firm*—Wenderoth, Lind & Ponack

[57] ABSTRACT

An embroidery stitch formation device for sewing machine comprising an outer cylinder which is mounted around a needle bar movable up and down in unison with the motion thereof, a nipple fitted to the lower end of the outer cylinder, passages for needle thread and cord provided slantwise through a frame and the outer cylinder, a rotary ring rotatably arranged on the outer cylinder having a driver gear on the upper portion thereof, a support arm provided with a tilted shaft on which is mounted a bobbin for bobbin thread, the support arm being positioned fixedly on the outer periphery of the rotary ring and a guide bar having guide holes for bobbin thread being mounted on the rotary ring, and while a lockstitch seam is being formed by a piece of needle thread and a piece of lockstitch thread, a piece of cord supplied through a passageway down to the needle in parallel therewith is wound with turns of bobbin thread supplied from the bobbin rotating around the outer cylinder by means of a rotating rotary ring, the cord also being locked by the piece of needle thread during the process of lockstitch formation.

4 Claims, 8 Drawing Figures

FIG. 1 "Priar Art"
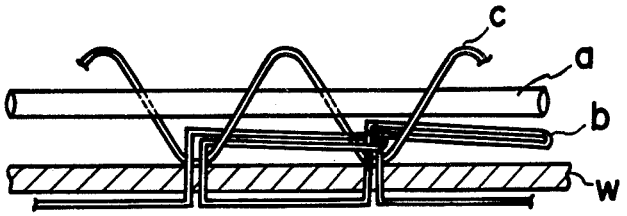
FIG. 4
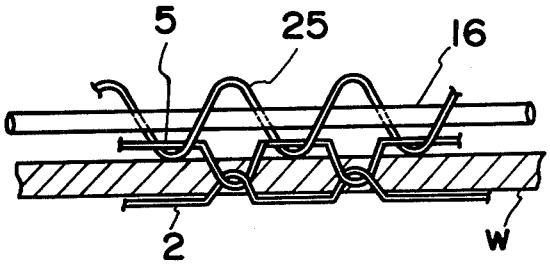
FIG. 6
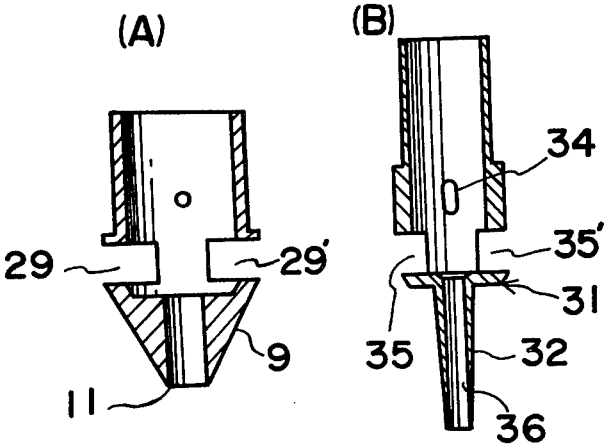

FIG. 2 "Priar Art"
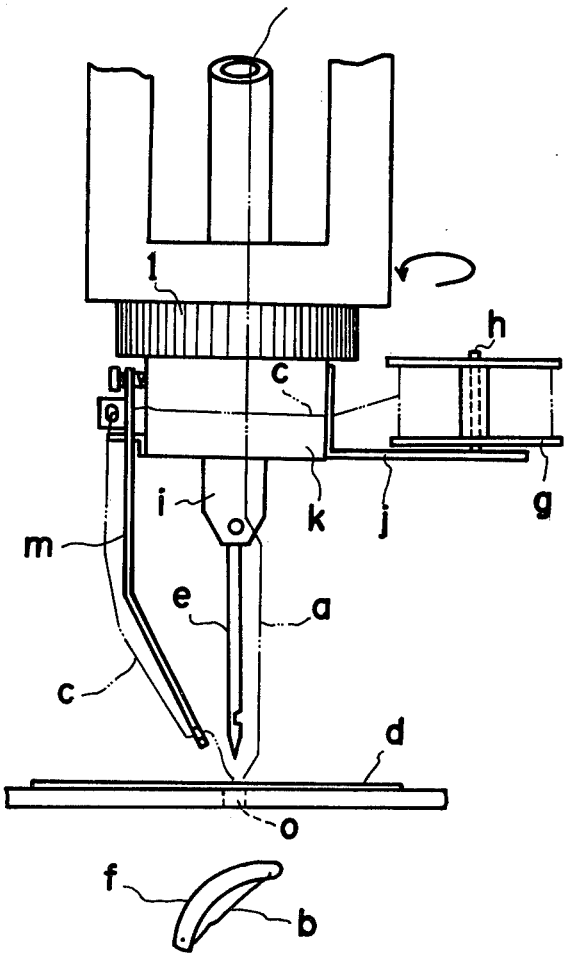

EMBROIDERY STITCH FORMATION DEVICE FOR SEWING MACHINE

BACKGROUND AND BRIEF SUMMARY OF THE INVENTION

The present invention relates to an embroidery stitch formation device for sewing machine. More specifically this invention contemplates providing an embroidery stitch formation device by adopting a lockstitch sewing machine.

In conventional embroidery machine, a chainstitch sewing machine is adopted whereby a chainstitch embroidery is formed as shown in FIG. 1 of the accompanying drawing. The sewing machine designed for this type of embroidery stitch formation is provided with a hook needle which functions to pick up a piece of chainstitch thread supplied through a looper located underneath a sewing machine bed while a piece of cord is wound with turns of bobbin thread which is also caught by the piece of chainstitch thread thereby chainstitch embroidery seams are formed.

The structure of embroidery seam formed by a chainstitch embroidery machine thus explained is illustrated in FIG. 1.

In a conventional chainstitch embroidery machine, a piece of thread for chainstitching is adopted to form a single thread chainstitch embroidery. Therefore, if a piece of chainstitch thread is inadvertently untied or come apart, for example, as by washing the embroidered fabrics or the like, the stitch formation may get loosen or be untied successively and usually a lot of skill is required for repairing the defects thereof.

In addition, as long as hook needle is used for the purpose, there may be a possibility that the hook needle tends to catch a yarn from among the woven fabrics together with a piece of chain thread during its upward motion thereby the yarn comes out of the surface of the fabrics. Naturally a smooth stitching operation may be hindered with the result than an efficient production of high grade embroidered goods may not be obtained.

It is an object of this invention to provide an embroidery stitch formation device to overcome the drawbacks heretofore mentioned by adopting a lockstitch sewing machine which is designed to form an embroidery seam which may not easily be untied or loosened wherein a piece of bobbin thread and a piece of cord which join in the formation of embroidery seam are reinforced by a lockstitch seam formed by a piece of needle thread and a piece of lockstitch bobbin thread to avoid an easy undoing of a seam.

In a conventional machine for chainstitch embroidery, as was explained heretofore and is shown in FIG. 2, a piece of cord (a) is wound with turns of a piece of bobbin thread (c) while a piece of thread (b) for chainstitching is caught by the piece of bobbin thread (c) during the stitching process of forming an embroidery seam. While the piece of cord (a) is hanging downward in parallel with a hook needle (e), the latter (e) is shifted downward through both a piece of cloth (d) and a hole (o) provided in a table (T) to catch the piece of chainstitch thread (b) provided in a looper (f) and as soon as the piece of chainstitch thread (b) is caught by the hook needle (e) and is lifted upward through the hole (o) of the table (T) to be thrown into a predetermined position to form a chainstitch, the piece of cord (a) is wound with turns of the piece of bobbin thread (c) supplied, through a thread guide (m), from a bobbin (g) rotatably supported on a support arm (j) positioned on a rotary ring (k) in unison with the rotation thereof in a direction of an arrow as illustrated in FIG. 2, and simultaneously with the formation of chainstitch by the piece of chainstitch thread (b) the piece of bobbin thread (c) is also caught thereby.

The bobbin (g) is mounted rotatably on the support arm (j) by means of an upright shaft (h) provided thereon. The support arm (j) is fixed horizontally to a rotary ring (k) having a rotatable gear (l). When a bulky bobbin thread (c) is wound on the bobbin (g) it may be impossible to supply an ample thread thereon because of the small capacity of the bobbin thus mounted upright on the support arm (j). Therefore, this causes a repetition of stopping the machine to supply bobbin thread thereon and entails not only a loss of time in machine operation but involves the use of an extra costly labor. This drawback may be overcome by mounting a large bobbin having a big capacity on a longer supporting arm fixedly protruding from rotary ring (k). However, this brings forth an increase of orbitual radius of the rotation when the bobbin (g) supported on the long support arm rotates around a needle bar (i) with a resultant slow rotation thereof coupled with drawbacks such as untimely and inadvertent unwinding of bobbin thread (c) due to the rotation of bobbin supported on the support arm and the centrifugal force created by the rotation of rotary ring (k) on which is mounted the long support arm.

In other words, the size of the bobbin is too small to be provided with an ample bobbin thread thereon at one time according to the conventional structure of bobbin means coupled with some difficulty of smooth unwinding of bobbin thread from the bobbin corresponding to the stitching speed of the sewing machine.

As will be explained hereinafter, suppose a lockstitch embroidery machine according to the present invention is provided with the bobbin means having the same structure as the conventional type chainstitch machine on a rotary ring the same drawback may be found.

It is another object of this invention to present bobbin means to overcome the above mentioned drawbacks by providing a longer slant arm on which is mounted a bigger bobbin slantwise and downwardly so that ample bobbin thread may be supplied thereon and unwinding of bobbin thread may be carried out smoothly and with time-wise relationship to stitching process regardless of the strong centrifugal force due to the rotation of rotary ring around the needle bar.

The above and further objects and novel features of the invention will be more fully appear from the following description when the same is read in connection with the accompanying drawings. It is to be expressly understood, however, that the drawing is for the purpose of illustration only and is not intended as a definition of the limits of the invention.

BRIEF DESCRIPTION OF THE DRAWINGS

FIG. 1 is an enlarged sectional view illustrating a conventional chainstitch embroidery formations.

FIG. 2 indicates an elevational view of embroidery device equipped with a conventional bobbin means.

FIG. 4 shows an enlarged section view of lockstitch embroidery seam embodying the present invention.

FIG. 6(A) indicates a section view of outer nipple and FIG. 6(B), a section view of inner nipple.

DETAILED DESCRIPTION OF THE INVENTION

Figure 3:
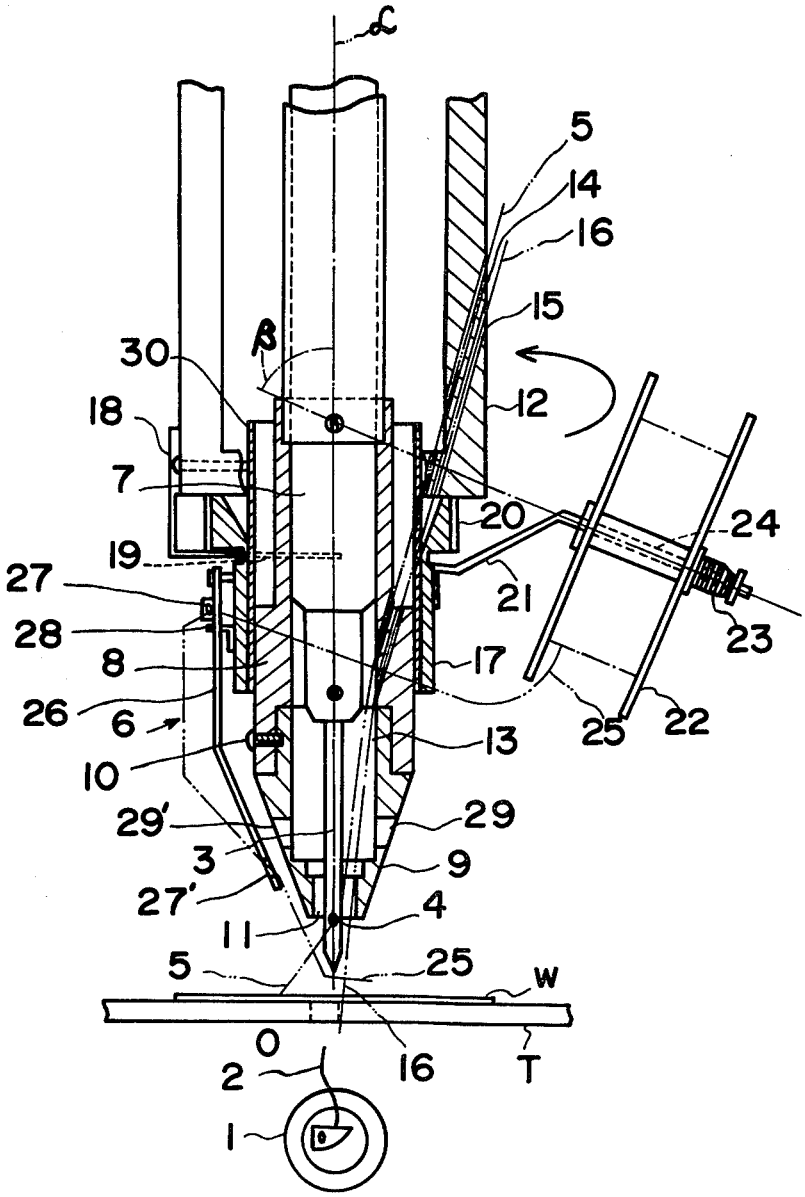
FIG. 3 indicates a sectional view of the device of embroidery sewing machine embodying a novel concept of the present invention including related members joining in an embroidery stitch formation.

Referring now to FIG. 3 in which an embroidery stitch formation device embodying the present invention is illustrated, we find a lockstitch sewing machine 6 which functions to form a lockstitch seam as known in prior art wherein a piece of lockstitch bobbin thread 2 is pulled up from a lockstitch bobbin case 1 by a piece of needle thread 5 to be locked with each other. The piece of needle thread 5 passes through both a passageway 14 and a cavity 13 to be threaded through a needle hole 4 of a needle bar 3 as will be explained hereinafter.

An outer cylinder 8 is mounted around a needle bar 7 movably in upward or downward direction in unison with the motion of the needle bar 7. A nipple 9 is fitted to the lower end of the outer cylinder 8 by means of a screw 10. The nipple 9 is designed to have a cavity 13 whose diameter is arranged same as the inner diameter of the outer cylinder 8.

The nipple 9 is also being tapered down to a lower end and is provided with a passage 11 for receiving therethrough the needle 3 fastened to the needle bar 7. A needle thread passageway 14 and a cord passageway 15 are provided slantwise in parallel with each other through a frame 12 and the outer cylinder 8. Inlet openings of the passageway start from an upper and outside surface of the frame 12 and extend downward to the inside cavity 13 respectively. A piece of needle thread 5 supplied from a bobbin through a take-up lever of a sewing machine of a prior art, not shown, is inserted through the needle thread passageway 14 and then passes through down into the cavity 13 to be threaded to a needle hole 4 disposed at the end of the needle 3, while a piece of cord 16 supplied from another bobbin of the sewing machine of a prior art, not shown, is also passing through the passageway 16 down into the cavity 13 and then into the nipple passageway 11 to be hangingly positioned in parallel with the needle 3.

A rotary ring 17 rotatably arranged on the outer cylinder 8 is rotatably supported by a supporter 19 of a semicircular shape of a supporting rod 18 which is fastened to the frame 12. A drive gear 20 is arranged on the upper periphery portion of the rotary ring 17. A support arm 21 having a shaft 24 for mounting a bobbin 22 on which bobbin thread 25 is wound is secured fixedly on the outer periphery of the rotary ring 17 at a position lower than the drive gear 20. The bobbin 22 designed for unwinding bobbin thread 25 thereon before mounted on the support arm 21 and for unwinding thread therefrom while the sewing machine is in operation is rotatably mounted on a shaft 24 of the support arm 21 provided with a coil spring 23 positioned around the end thereof.

In this embodiment of the present invention, it is shown that a shaft 24 for mounting the bobbin 22 thereon is so designed as to be tilted or slanted outwardly and downwardly with respect to an axis of the needle bar 7 at an angle of $\beta$ preferably 45–75 degrees so that bobbin thread 25 provided on the bobbin 22 may not be unwound too fast or untimely due to centrifugal force due to the rotation of the bobbin 22 around the outer cylinder 8 and the needle bar 7 in unison with the rotation of rotary ring 17.

A piece of bobbin thread 25 supplied unwindingly from the bobbin 22 is guided through guide holes 27 and 27' provided at the upper end and lower end of a guide bar 26 respectively and finally comes down to be positioned underneath the nipple 9 and the needle 3. The guide bar 26 mounted on the rotary ring 17 extends downward toward the end of nipple 9. A stopper 28 is fixedly arranged in the ring 17. The stopper 28 is positioned against the guide bar 26 in reverse to the rotating direction of the rotary ring 17.

Numerals 29 and 29' denote eyeholes. Numeral 30 indicates a collar cylinder arranged on the outer cylinder 8 and is devised for reducing the friction on the outer cylinder 8 during the operation of the rotary ring 17 rotating therearound or during the sliding motion of the outer cylinder.

Descriptions will now proceed to the operation of the device for embroidery stitch formation for sewing machine of the present invention whose structure has heretofore been described in detail.

First of all a piece of fabric on which embroidery stitchings are to be formed is positioned at a predetermined place on a table T or on a sewing machine bed, as the case may be, before the machine starts to operate.

With the actuation of driving mechanism of a lockstitch sewing machine of a prior art, now shown, the outer cylinder 8 having the nipple 9 as well as the needle bar 7 provided with a threaded needle 3 start a downward motion until the tip of the nipple 9 makes a pressing contact onto a fabric W and the needle 3 provided with a piece of needle thread 5 is shifted further down into the bobbin 1 provided underneath and table T through the hole 0 to catch a piece of lockstitch bobbin thread 2 supplied from the lockstitch bobbin 1. In unison with an upward motion of the driving mechanism of the lockstitch sewing machine 6, the related members joining in lockstitch formations are lifted upward to be restored to their former position thereby both the piece of needle thread 5 and the piece of lockstitch bobbin thread 2 are locked with each other to form a lockstitch seam in the fabrics W. It should be noted that up and down motion of the needle bar 7 and the forming of lockstitch seam by two threads 2 and 5 through related members such as a take-up lever means and a crank means of the sewing machine are so arranged time-wise as known in prior art so that the related members may join in stitch formation.

While the lockstitch seam is being formed by means of two pieces of thread 2 and 5, the drive gear 20 of the rotary ring 17 is driven by a driving mechanism of a prior art, now shown, to rotate the rotary ring 17 around the outer cylinder 8 accompanied by the bobbin 22 mounted on the support arm 21 in a direction indicated by an arrow as shown in FIG. 3.

Figure 5:
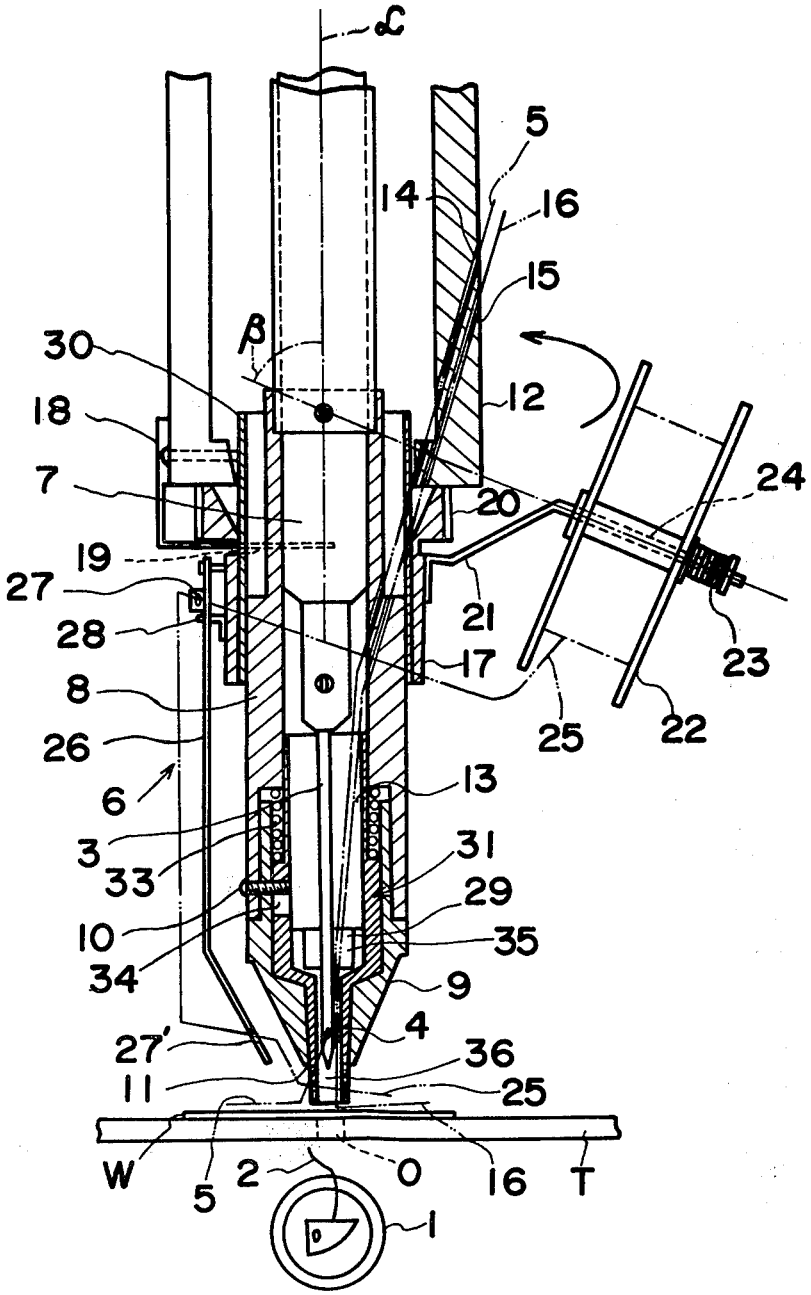
FIG. 5 illustrates an embroidery sewing machine equipped with another embodiment of nipple means according to the present invention.

While the bobbin 22 rotates around the outer cylinder 8 the piece of bobbin thread 25 is unwound therefrom and the piece of cord 16 is wound with turns of the piece of the bobbin thread 25 which is simultaneously locked by the piece of needle thread 5 whereby lockstitch embroidery seams are formed as is shown in FIG. 4, which illustrates the structure of the seam wherein the piece of cord 16 is wound with turns of the piece of bobbin thread 25 which is in turn locked by the piece of needle thread 5 with which is locked the piece of lockstitch bobbin thread 2. FIGS. 5 and 6 illustrate another embodiment of a nipple means according to the present invention.

A nipple 9 is provided with a slidable inner nipple 31 which is slidably positioned thereinside and has a cylindrical projection 32 slidably arranged through the passage 11 of the nipple 9. The projection 32 may be pushed downward through the passage 11 by means of biasing force of a coil spring 33 arranged around one end portion of the inner nipple 31. The cylindrical projection 32 has a passage 36 through which a needle 3 provided with a piece of needle thread 5 and a piece of cord 16 may be passable. Numeral 34 indicates a guide hole through which a screw 10 is positioned to fasten the outer cylinder 8 to the slidable inner nipple 31 so that the slidable inner nipple 31 may be shiftable up and down within a lengthwise distance of the hole 34. Numeral 35 and 35' are a pair of eyeholes arranged communicatingly with another pair of eyeholes 29 and 29' of the nipple 9.

The operation of the device provided with a slidable inner nipple 31 is almost similar to that of the embodiment of the invention heretofore described. However, the cylindrical projection 32 is pushed downward onto the fabrics W by means of biasing force of the coil spring 33 whenever the outer cylinder 8, the needle bar 7 and the nipple 9 are shifted down simultaneously by the actuation of a driving mechanism of sewing machine.

The cylindrical projection 32 shifted down as explained above assists to keep the fabric W upon the table T at a predetermined position. The operation for stitch formation of this invention may be performed efficiently by a co-participation of the related thread members as heretofore described, which comprises a piece of needle thread 5 provided through the needle hole 4, a piece of lockstitch bobbin thread 2 which may be locked by the piece of needle thread 5, a piece of bobbin thread 25 supplied from the bobbin 22 which is rotatably mounted on the supported arm 21 positioned on the rotary ring 17 which is arranged rotatable around the outer cylinder 8, and a piece of cord 16 which is wound with turns of bobbin thread 25 which is unwound from the bobbin 22 in accordance with the rotation of the rotary ring 17 around the outer cylinder 8 and is guided by guide bar 26 while the piece of bobbin thread 25 is so devised as to be locked by the piece of needle thread 5.

The device for forming an embroidery stitching of the present invention wherein four pieces of threads including a piece of needle thread, a piece of lockstitch bobbin thread, a piece of cord and a piece of bobbin thread are utilized for an embroidery stitch formation as heretofore described may be adapted for a tape attaching sewing machine, wherein a tape is sewn on a fabric by means of a piece of needle thread and a piece of lockstitch bobbin thread supplied by a lockstitch sewing machine which is arranged time-wise so that the thread members may join in the stitch formation.

Figure 7:
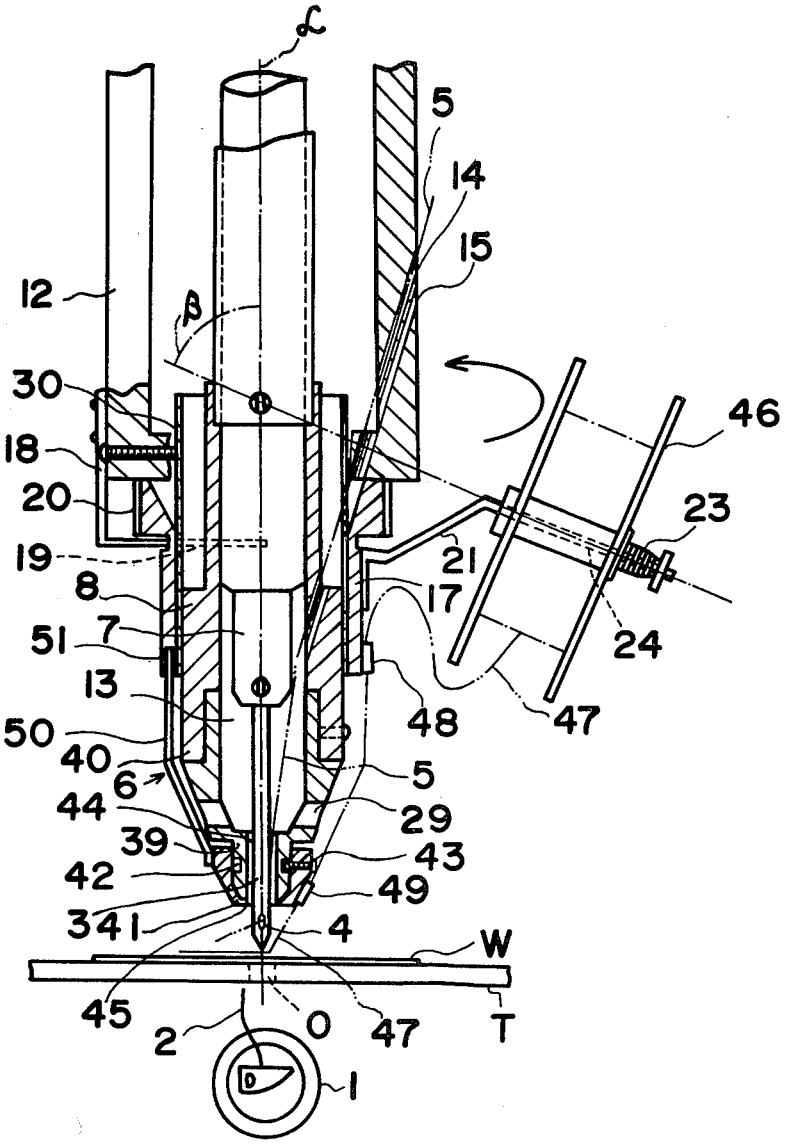
FIG. 7 indicates a sectional view of sewing machine device designed for tape attaching according to the present invention.

FIG. 7 illustrates a device for tape attaching sewing machine wherein a piece of tape or cord, a piece of needle thread and a piece of lockstitch bobbin thread may join in a stitch formation while a cord being eliminated.

The structure of the device of tape attaching sewing machine, as shown in FIG. 7, is almost similar to the embodiment illustrated in FIG. 3 according to the invention.

An upper nipple 40 having a narrow end portion 39 is inserted into an outer cylinder 8 to be fixed therewith. Below the narrow end portion 39 of the upper nipple 40 is arranged a lower nipple 41 which is positioned rotatably around the end portion 39. In the lower nipple 41 is provided a screw 43 slidably engaging in an annular groove 42 defined in the periphery of the end portion 39. A common passageway is provided through a passage 44 of the nipple 40 and a passage 45 of the lower nipple 41 through which a needle 3 provided with a needle bar 7 is passable.

A needle thread passageway 14 is provided slantwise through a frame 12 and the outer cylinder 8. An opening of the passageway 14 starts from the periphery of upper and outside of the frame 12 and extends down into a lower cavity 13. A piece of needle thread 5 supplied from a bobbin through a take-up lever means of a sewing machine of a prior art, not shown in the drawing is inserted into the passageway 14 and then passes through the cavity 13 and the common passage consisting of passages 44 and 45 to be finally threaded with a needle 3.

A tape bobbin 46 for winding or unwinding a piece of tape 47 is rotatably mounted on an support arm 21 positioned fixedly on the rotary ring 17 as heretofore explained in FIG. 3.

On one edge of the support arm 21 is mounted a coil spring 23 to adjust unwinding of the bobbin 46 at a predetermined speed. The support arm 21 for mounting the tape bobbin 46 thereon is also so devised as to be tilted outwardly and downwardly with respect to an axis $\alpha$ of the needle bar 7 at an angle of $\beta$ preferably 45–75 degrees as was heretofore explained according to FIG. 3. A piece of tape 47 supplied unwindingly from the tape bobbin 46 is guided through guide holes 48 and 49 provided on the rotary ring 17 and on the lower nipple 41 respectively and extends further downward to be located horizontally underneath the lower nipple 41. One end of a connecting support rod 50 is inserted fixedly into a slit 51 of the rotary ring 17 while the other end thereof is fixed on the lower nipple 41 whereby the lower nipple 41 is arranged to be rotatable simultaneously with the rotation of the rotary ring 17.

A fabrics W on which the piece of tape 47 is to be attached by sewing is positioned on an embroidery frame, not shown, which is slidingly shiftable on a table T to a predetermined direction in response to the actuation of an electrically driven apparatus of a prior art, not shown.

Simultaneously with the actuation of the driving means of sewing machine of a prior art, the outer cylinder 8, the upper nipple 40 together with the lower nipple 41, the needle bar 7 equipped with the needle 6 threaded with the piece of needle thread 5 shift simultaneously downward through a table hole O until the tip of the lower nipple 41 touches onto the fabrics W and the needle 3 is shifted further down into the bobbin 1 through the piece of tape 47 layed on an embroidery frame, not shown, to catch the peice of lockstitch bobbin thread 2 and as soon as the bobbin thread 2 is caught by the needle thread 5 and in unison with reverse motion of the lockstitch sewing machine the needle bar 7 is lifted upward, thereby a lockstitch seam is formed in succession through the fabrics W and the piece of tape 47, whereby the piece of tape 47 is attached to the fabrics W by sewing. The piece of tape 47 is arranged to be located on the fabrics W underneath the needle 3 guided through guide means 48 and 49 after being unwound from the bobbin 46 which rotates around the outer cylinder 8 in unison with the rotation of the rotary ring 17 together with the lower nipple 41.

The device for embroidery stitch formation by sewing machines according to the present invention produces an embroidery stitches of lockstitch type which is not easily untied compared with a conventional chainstitch embroidery and a bobbin means is also so constructed to supply bobbin thread as to be unwound smoothly correspondingly to the speed of stitching operation performed by the device coupled with an advantage of being adapted for attaching tapes to fabrics by sewing.

What we claim is:

1. A device for embroidery stitch formation by a lockstitch sewing machine having a needle bar equipped with a needle provided with a piece of needle thread through a needle hole thereof and a lockstitch bobbin provided with a piece of lockstitch bobbin thread therein comprising:

an outer cylinder which is mounted around the needle bar movably upward and downward in unison with the motion of the needle bar, a nipple having a passage therethrough fitted to the lower end of the outer cylinder, a passageway for needle thread and a passage for a cord being provided slantwise through a frame and the outer cylinder, a rotary ring which is rotatably arranged on the outer cylinder and is rotatably supported by a supporter of a supporting rod which is fastened to the frame, a drive grear arranged on the upper periphery portion of the rotary ring, a support arm provided with a tilted shaft on which is mounted a bobbin on which bobbin thread is wound being positioned fixedly on the outer periphery of the rotary ring at the position lower than the drive gear, and a guide bar having guide holes for guiding a piece of bobbin thread supplied from the bobbin being mounted on the rotary ring, whereby embroidery stitches are formed by thread members comprising: a piece of needle thread supplied through a passageway to be threaded with a needle, a piece of lockstitch bobbin thread supplied from a lockstitch bobbin both of which join in a formation of lockstitch seam and a piece of cord hanging down in parallel with a needle bar through a passageway, which is wound with turns of a piece of bobbin thread supplied from a bobbin mounted on a shaft of a support arm which is rotatably fixed on a rotary ring arranged rotatable around an outer cylinder, said bobbin thread being locked by said needle thread during the process of stitch formation.

2. In a device for embroidery stitch formation as claimed in 1, wherein the shaft of the support arm for mounting the bobbin thread thereon is devised to be slanted outwardly and downwardly with respect to an axis of the needle bar.

3. In a device for embroidery stitch formation as claimed in 1, wherein the nipple is provided with an inner nipple thereinside having a cylindrical projection which may be slidably pushed down through the passage of the nipple by means of biasing force of a coil spring arranged around one end portion of the inner nipple, a passageway for the needle provided with needle thread and for a cord being arranged through the cylindrical projection.

4. In a device for embroidery stitch formation as claimed in 1, there are an upper nipple provided with a lower nipple rotatably arranged underneath thereof, a guide means for guiding a piece of tape being arranged on the outer cylinder and on the lower nipple respectively and a connecting support rod bridging between the outer cylinder and the lower nipple.

* * * * *